US006833046B2

(12) United States Patent
Wright

(10) Patent No.: US 6,833,046 B2
(45) Date of Patent: Dec. 21, 2004

(54) PLANARIZING MACHINES AND METHODS FOR MECHANICAL AND/OR CHEMICAL-MECHANICAL PLANARIZATION OF MICROELECTRONIC-DEVICE SUBSTRATE ASSEMBLIES

(75) Inventor: David Q. Wright, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 144 days.

(21) Appl. No.: 10/057,600

(22) Filed: Jan. 24, 2002

(65) Prior Publication Data

US 2002/0069967 A1 Jun. 13, 2002

Related U.S. Application Data

(62) Division of application No. 09/565,639, filed on May 4, 2000.

(51) Int. Cl.[7] ..... C23F 1/00

(52) U.S. Cl. ..... 156/345.12; 156/345.13; 156/345.29; 451/41; 451/60; 451/66; 451/539

(58) Field of Search ..... 156/345.12, 345.13, 156/345.29; 450/41, 60, 66, 539

(56) References Cited

U.S. PATENT DOCUMENTS

| | | | |
|---|---|---|---|
| 5,036,015 | A | 7/1991 | Sandhu et al. |
| 5,069,002 | A | 12/1991 | Sandhu et al. |
| 5,081,796 | A | 1/1992 | Schultz |
| 5,209,816 | A | 5/1993 | Yu et al. |
| 5,222,329 | A | 6/1993 | Yu |
| 5,225,034 | A | 7/1993 | Yu et al. |
| 5,232,875 | A | 8/1993 | Tuttle et al. |

(List continued on next page.)

OTHER PUBLICATIONS

Seiichi Kondo, Noriyuki Sakuma, Yoshio Homma, Yasushi Goto, Naofumi Ohashi, Hizuru Yamaguchi, and Nobuo Owada, "Abrasive–Free Polishing for Copper Damascene Interconnection", *Journal of the Electrochemical Society*, 147 (10) pp. 3907–3913 (2000).

*Primary Examiner*—George A. Goudreau
(74) *Attorney, Agent, or Firm*—Perkins Coie LLP

(57) ABSTRACT

Planarizing machines and methods for selectively using abrasive slurries on fixed-abrasive planarizing pads in mechanical and/or chemical-mechanical planarization of microelectronic substrate assemblies. In one embodiment of a method in accordance with the invention, a microelectronic substrate is planarized by positioning a fixed-abrasive planarizing pad on a table of a planarizing machine, covering at least a portion of a planarizing surface on the pad with a first abrasive planarizing solution during a first stage of a planarizing cycle, and then adjusting a concentration of the abrasive particles on the planarizing surface at a second stage of the planarizing cycle after the first stage. The concentration of the second abrasive particles can be adjusted during the second stage of the planarizing cycle by coating the planarizing surface with a non-abrasive second planarizing solution without abrasive particles during the second stage. The second planarizing solution can be dispensed onto the planarizing surface after terminating a flow of the first planarizing solution at the end of the first stage of the planarizing cycle, or the flow of the first planarizing solution can be continued after the first stage of the planarizing cycle. Several embodiments of these methods accordingly use only the abrasive first planarizing solution during a pre-wetting or initial phase of the first stage of the planarizing cycle, and then either only the second planarizing solution or a combination of the first and second planarizing solutions during a second stage of the planarizing cycle. Additionally, abrasive planarizing solution can be dispensed at the end of the polish cycle (activated by time or endpoint) in order to improve polish characteristics of fixed abrasives polish on planarized wafers.

19 Claims, 4 Drawing Sheets

U.S. PATENT DOCUMENTS

| | | | |
|---|---|---|---|
| 5,234,867 | A | 8/1993 | Schultz et al. |
| 5,240,552 | A | 8/1993 | Yu et al. |
| 5,244,534 | A | 9/1993 | Yu et al. |
| 5,245,790 | A | 9/1993 | Jerbic |
| 5,245,796 | A | 9/1993 | Miller et al. |
| RE34,425 | E | 11/1993 | Schultz |
| 5,354,490 | A | 10/1994 | Yu et al. |
| 5,413,941 | A | 5/1995 | Koos et al. |
| 5,421,769 | A | 6/1995 | Schultz et al. |
| 5,433,651 | A | 7/1995 | Lustig et al. |
| 5,439,551 | A | 8/1995 | Meikle et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,533,924 | A | 7/1996 | Stroupe et al. |
| 5,540,810 | A | 7/1996 | Sandhu et al. |
| 5,609,718 | A | 3/1997 | Meikle |
| 5,618,381 | A | 4/1997 | Doan et al. |
| 5,618,447 | A | 4/1997 | Sandhu |
| 5,643,048 | A | 7/1997 | Iyer |
| 5,643,060 | A | 7/1997 | Sandhu et al. |
| 5,658,183 | A | 8/1997 | Sandhu et al. |
| 5,658,190 | A | 8/1997 | Wright et al. |
| 5,663,797 | A | 9/1997 | Sandhu |
| 5,664,988 | A | 9/1997 | Stroupe et al. |
| 5,679,065 | A | 10/1997 | Henderson |
| 5,700,180 | A | 12/1997 | Sandhu et al. |
| 5,702,292 | A | 12/1997 | Brunelli et al. |
| 5,730,642 | A | 3/1998 | Sandhu et al. |
| 5,738,562 | A | 4/1998 | Doan et al. |
| 5,747,386 | A | 5/1998 | Moore |
| 5,777,739 | A | 7/1998 | Sandhu et al. |
| 5,792,709 | A | 8/1998 | Robinson et al. |
| 5,795,495 | A | 8/1998 | Meikle |
| 5,798,302 | A | 8/1998 | Hudson et al. |
| 5,807,165 | A | 9/1998 | Uzoh et al. |
| 5,827,781 | A | 10/1998 | Skrovan et al. |
| 5,830,806 | A | 11/1998 | Hudson et al. |
| 5,842,909 | A | 12/1998 | Sandhu et al. |
| 5,851,135 | A | 12/1998 | Sandhu et al. |
| 5,855,804 | A | 1/1999 | Walker |
| 5,868,896 | A | 2/1999 | Robinson et al. |
| 5,876,273 | A | 3/1999 | Yano et al. |
| 5,882,248 | A | 3/1999 | Wright et al. |
| 5,893,754 | A | 4/1999 | Robinson et al. |
| 5,895,550 | A | 4/1999 | Andreas |
| 5,897,426 | A | 4/1999 | Somekh |
| 5,910,846 | A | 6/1999 | Sandhu |
| 5,916,819 | A | 6/1999 | Skrovan et al. |
| 5,930,699 | A | 7/1999 | Bhatia |
| 5,934,980 | A | 8/1999 | Koos et al. |
| 5,936,733 | A | 8/1999 | Sandhu et al. |
| 5,945,347 | A | 8/1999 | Wright |
| 5,954,912 | A | 9/1999 | Moore |
| 5,967,030 | A | 10/1999 | Blalock |
| 5,972,792 | A | 10/1999 | Hudson |
| 5,980,363 | A | 11/1999 | Meikle et al. |
| 5,981,396 | A | 11/1999 | Robinson et al. |
| 5,990,012 | A | 11/1999 | Robinson et al. |
| 5,994,224 | A | 11/1999 | Sandhu et al. |
| 5,997,384 | A | 12/1999 | Blalock |
| 6,007,408 | A | 12/1999 | Sandhu |
| 6,019,806 | A | 2/2000 | Sees et al. |
| 6,039,633 | A | 3/2000 | Chopra |
| 6,040,245 | A | 3/2000 | Sandhu et al. |
| 6,046,111 | A | 4/2000 | Robinson |
| 6,054,015 | A | 4/2000 | Brunelli et al. |
| 6,057,602 | A | 5/2000 | Hudson et al. |
| 6,060,395 | A | 5/2000 | Skrovan et al. |
| 6,066,030 | A | 5/2000 | Uzoh |
| 6,071,816 | A | 6/2000 | Watts et al. |
| 6,074,286 | A | 6/2000 | Ball |
| 6,077,785 | A | 6/2000 | Andreas |
| 6,083,085 | A | 7/2000 | Lankford |
| 6,102,778 | A | 8/2000 | Morita |
| 6,108,092 | A | 8/2000 | Sandhu |
| 6,110,820 | A | 8/2000 | Sandhu et al. |
| 6,114,245 | A | 9/2000 | Vandamme et al. |
| 6,116,988 | A | 9/2000 | Ball |
| 6,120,354 | A | 9/2000 | Koos et al. |
| 6,124,207 | A | 9/2000 | Robinson et al. |
| 6,135,856 | A | 10/2000 | Tjaden et al. |
| 6,136,218 | A | 10/2000 | Skrovan et al. |
| 6,139,402 | A | 10/2000 | Moore |
| 6,143,123 | A | 11/2000 | Robinson et al. |
| 6,143,155 | A | 11/2000 | Adams et al. |
| 6,152,808 | A | 11/2000 | Moore |
| 6,176,763 | B1 | 1/2001 | Kramer et al. |
| 6,176,992 | B1 | 1/2001 | Talieh |
| 6,180,525 | B1 | 1/2001 | Morgan |
| 6,184,571 | B1 | 2/2001 | Moore |
| 6,187,681 | B1 | 2/2001 | Moore |
| 6,190,494 | B1 | 2/2001 | Dow |
| 6,191,037 | B1 | 2/2001 | Robinson et al. |
| 6,191,864 | B1 | 2/2001 | Sandhu |
| 6,193,588 | B1 | 2/2001 | Carlson |
| 6,200,901 | B1 | 3/2001 | Hudson et al. |
| 6,203,404 | B1 | 3/2001 | Joslyn et al. |
| 6,203,407 | B1 | 3/2001 | Robinson |
| 6,203,413 | B1 | 3/2001 | Skrovan |
| 6,206,754 | B1 | 3/2001 | Moore |
| 6,206,756 | B1 | 3/2001 | Chopra et al. |
| 6,206,757 | B1 | 3/2001 | Custer et al. |
| 6,206,769 | B1 | 3/2001 | Walker |
| 6,208,425 | B1 | 3/2001 | Sandhu et al. |
| 6,210,257 | B1 | 4/2001 | Carlson |
| 6,213,845 | B1 | 4/2001 | Elledge |
| 6,218,316 | B1 | 4/2001 | Marsh |
| 6,224,466 | B1 | 5/2001 | Walker et al. |
| 6,227,955 | B1 | 5/2001 | Custer et al. |
| 6,234,874 | B1 | 5/2001 | Ball |
| 6,234,877 | B1 | 5/2001 | Koos et al. |
| 6,234,878 | B1 | 5/2001 | Moore |
| 6,237,483 | B1 | 5/2001 | Blalock |
| 6,250,994 | B1 | 6/2001 | Chopra et al. |
| 6,251,785 | B1 | 6/2001 | Wright |
| 6,261,151 | B1 | 7/2001 | Sandhu et al. |
| 6,261,163 | B1 | 7/2001 | Walker et al. |
| 6,267,650 | B1 | 7/2001 | Hembree |
| 6,271,139 | B1 | 8/2001 | Alwan et al. |
| 6,273,786 | B1 | 8/2001 | Chopra et al. |
| 6,273,796 | B1 | 8/2001 | Moore |
| 6,276,996 | B1 | 8/2001 | Chopra |
| 6,284,660 | B1 | 9/2001 | Doan |
| 6,287,879 | B1 | 9/2001 | Gonzales et al. |
| 6,290,572 | B1 | 9/2001 | Hofmann |
| 6,301,006 | B1 | 10/2001 | Doan |
| 6,306,012 | B1 | 10/2001 | Sabde |
| 6,306,014 | B1 | 10/2001 | Walker et al. |
| 6,306,768 | B1 | 10/2001 | Klein |
| 6,312,486 | B1 | 11/2001 | Sandhu et al. |
| 6,312,558 | B2 | 11/2001 | Moore |
| 6,313,038 | B1 | 11/2001 | Chopra et al. |
| 6,319,420 | B1 | 11/2001 | Dow |
| 6,323,046 | B1 | 11/2001 | Agarwal |
| 6,328,632 | B1 | 12/2001 | Chopra |
| 6,331,488 | B1 | 12/2001 | Doan et al. |
| 6,338,667 | B2 | 1/2002 | Sandhu et al. |
| 6,350,180 | B2 | 2/2002 | Southwick |
| 6,350,691 | B1 | 2/2002 | Lankford |
| 6,352,466 | B1 | 3/2002 | Moore |

6,354,917 B1 3/2002 Ball
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,417 B2 3/2002 Walker et al.
6,362,105 B1 3/2002 Moore
6,364,746 B2 4/2002 Moore
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,375,548 B1 4/2002 Andreas
6,376,381 B1 4/2002 Sabde
6,387,289 B1 * 5/2002 Wright ..... 216/88
6,402,884 B1 * 6/2002 Robinson et al. ..... 156/345
6,407,000 B1 * 6/2002 Hudson ..... 438/693

* cited by examiner-

PLANARIZING MACHINES AND METHODS FOR MECHANICAL AND/OR CHEMICAL-MECHANICAL PLANARIZATION OF MICROELECTRONIC-DEVICE SUBSTRATE ASSEMBLIES

CROSS REFERENCE TO RELATED APPLICATION

This application is a divisional of pending U.S. patent application Ser. No. 09/565,639, filed on May 4, 2000.

TECHNICAL FIELD

The present invention is directed toward mechanical and/or chemical-mechanical planarization of microelectronic-device substrate assemblies. More specifically, the invention is related to planarizing machines and methods for selectively using abrasive slurries on fixed-abrasive planarizing pads.

BACKGROUND OF THE INVENTION

Mechanical and chemical-mechanical planarizing processes (collectively "CMP") remove material from the surface of semiconductor wafers, field emission displays or other microelectronic substrates in the production of microelectronic devices and other products. FIG. 1 schematically illustrates a CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a substrate 12 may be attached, or the substrate 12 may be attached to a resilient pad 34 in the head 32. The head 32 may be a free-floating wafer carrier, or an actuator assembly 36 may be coupled to the head 32 to impart axial and/or rotational motion to the substrate 12 (indicated by arrows H and I, respectively).

The planarizing pad 40 and a planarizing solution 44 on the pad 40 collectively define a planarizing medium that mechanically and/or chemically-mechanically removes material from the surface of the substrate 12. The planarizing pad 40 can be a fixed-abrasive planarizing pad in which abrasive particles are fixedly bonded to a suspension material. In fixed-abrasive applications, the planarizing solution 44 is typically a non-abrasive "clean solution" without abrasive particles. In other applications, the planarizing pad 40 can be a non-abrasive pad composed of a polymeric material (e.g., polyurethane), resin, felt or other suitable materials. The planarizing solutions 44 used with the non-abrasive planarizing pads are typically abrasive slurries with abrasive particles suspended in a liquid.

To planarize the substrate 12 with the CMP machine 10, the carrier assembly 30 presses the substrate 12 face-downward against the polishing medium. More specifically, the carrier assembly 30 generally presses the substrate 12 against the planarizing liquid 44 on a planarizing surface 42 of the planarizing pad 40, and the platen 20 and/or the carrier assembly 30 move to rub the substrate 12 against the planarizing surface 42. As the substrate 12 rubs against the planarizing surface 42, material is removed from the face of the substrate 12.

CMP processes should consistently and accurately produce a uniformly planar surface on the substrate to enable precise fabrication of circuits and photo-patterns. During the construction of transistors, contacts, interconnects and other features, many substrates develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a substrate.

In the highly competitive semiconductor industry, it is also desirable to maximize the throughput of CMP processing by producing a planar surface on a substrate as quickly as possible. The throughput of CMP processing is a function, at least in part, of the polishing rate of the substrate assembly and the ability to accurately stop CMP processing at a desired endpoint. Therefore, it is generally desirable for CMP processes to provide (a) a uniform polishing rate across the face of a substrate to enhance the planarity of the finished substrate surface, and (b) a reasonably consistent polishing rate during a planarizing cycle to enhance the accuracy of determining the endpoint of a planarizing cycle.

Although fixed-abrasive planarizing pads have several advantages compared to non-abrasive pads, fixed-abrasive pads may not produce consistent polishing rates throughout a planarizing cycle. One drawback of fixed-abrasive pads is that the polishing rate may be unexpectedly low at the beginning of a planarizing cycle. The inconsistency of the polishing rate for fixed-abrasive pads is not completely understood, but when a non-abrasive planarizing solution is used on a fixed-abrasive pad, the polishing rate of a topographical surface starts out low and then increases during an initial stage of a planarizing cycle. Such an increase in the polishing rate of a topographical substrate is unexpected because the polishing rate of a topographical substrate on a non-abrasive pad with an abrasive slurry generally decreases during the initial stage of a planarizing cycle. Therefore, it would be desirable to increase the consistency of the polishing rate on fixed-abrasive pads.

Another drawback of fixed-abrasive pads is that the polishing rate is low when planarizing a blanket surface (e.g., a planar surface that is not yet at the endpoint). The polishing rate of blanket surfaces is also relatively low on non-abrasive pads, but the polishing rate of such surfaces is generally even lower on fixed-abrasive pads. Therefore, it would be desirable to increase the polishing rate of blanket surfaces when using fixed-abrasive pads.

SUMMARY OF THE INVENTION

The present invention is directed toward planarizing machines and methods for selectively using abrasive slurries on fixed-abrasive planarizing pads in mechanical and/or chemical-mechanical planarization of microelectronic substrate assemblies. In one embodiment of a method in accordance with the invention, a microelectronic substrate is planarized by positioning a fixed-abrasive planarizing pad on a table of a planarizing machine, covering at least a portion of a planarizing surface on the pad with a first abrasive planarizing solution during a first stage of a planarizing cycle, and then adjusting a concentration of the abrasive particles on the planarizing surface at a second stage of the planarizing cycle. The fixed-abrasive pad can include a planarizing medium comprising a binder and a plurality of first abrasive particles fixedly attached to the binder so that at least a share of the first abrasive particles are exposed at the planarizing surface. The first abrasive planarizing solution has a plurality of second abrasive particles that are distributed across at least a portion of the planarizing surface during the first stage of the planarizing cycle. The first abrasive planarizing solution and the fixed-abrasive pad operate together to remove material from the microelectronic substrate. For example, material can be removed from the microelectronic substrate by rubbing the substrate against the first abrasive particles at the planarizing surface and the second abrasive particle suspended in the first planarizing solution.

The concentration of the second abrasive particles on the planarizing surface can be adjusted during the second stage of the planarizing cycle by a number of different procedures. In one embodiment, the planarizing surface is coated with a second non-abrasive second planarizing solution without abrasive particles during the second stage of the planarizing cycle to reduce the concentration of the second abrasive particles on the planarizing surface. The second planarizing solution can be dispensed onto the planarizing surface after terminating a flow of the first planarizing solution at the end of the first stage of the planarizing cycle. In another embodiment, the flow of the first planarizing solution can be continued after the first stage of the planarizing cycle, and a flow of the second planarizing solution can be combined with the first planarizing solution during the second stage so that a combined flow of the first and second planarizing solutions is dispensed onto the polishing pad. The methods accordingly use the abrasive first planarizing solution during a pre-wetting or initial phase of the planarizing cycle, and then they use either only the second planarizing solution or a combination of the first and second planarizing solutions during a subsequent phase the second stage of the planarizing cycle.

DETAILED DESCRIPTION

The present invention is directed toward planarizing pads, planarizing machines and methods for using abrasive planarizing solutions on fixed-abrasive pads in mechanical and/or chemical-mechanical planarization of microelectronic-device substrates. The terms "substrate" and "substrate assembly" include semiconductor wafers, field emission displays and other types of substrates before or after microelectronic devices are formed on the substrates. Many specific details of the invention are described below with reference to web-format planarizing applications to provide a thorough understanding of such embodiments. The present invention, however, can also be practiced using rotary planarizing machines. A person skilled in the art will thus understand that the invention may have additional embodiments, or that the invention may be practiced without several of the details described below.

Figure 1:
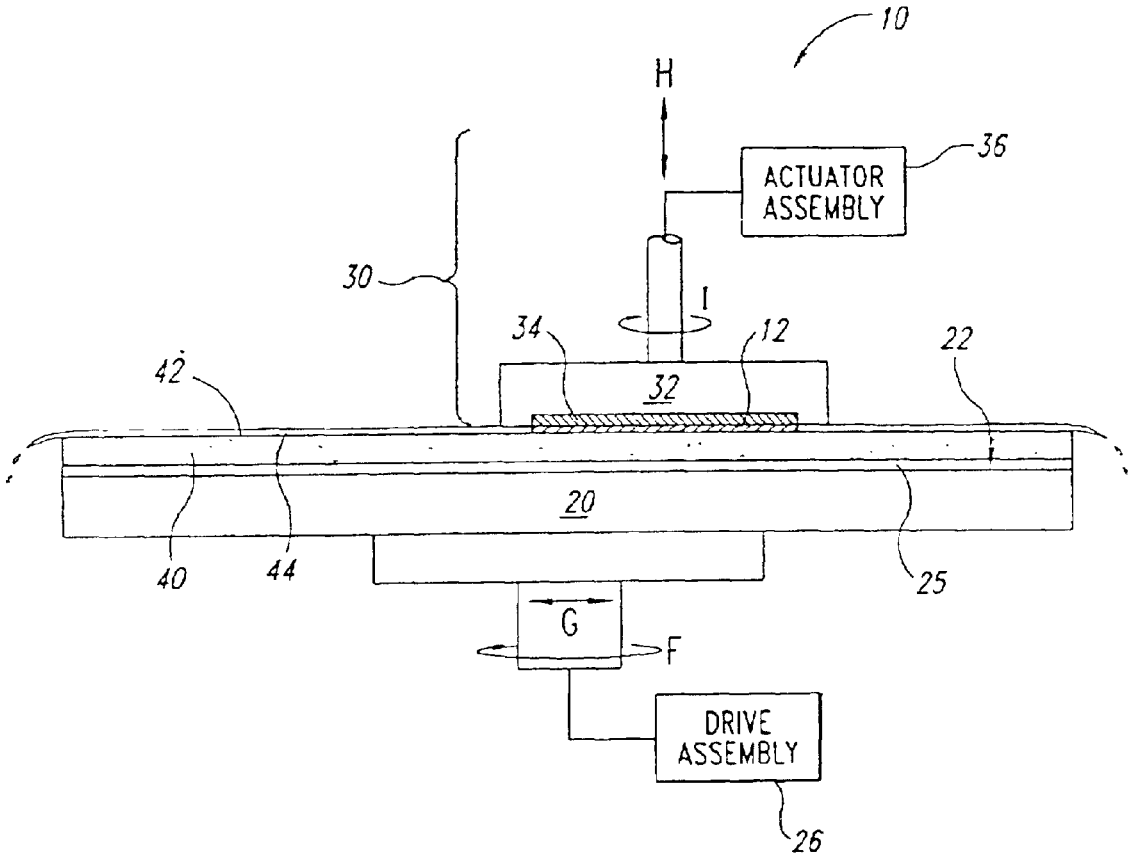
FIG. 1 is a schematic cross-sectional view of a rotary planarizing machine in accordance with the prior art.
Figure 2:
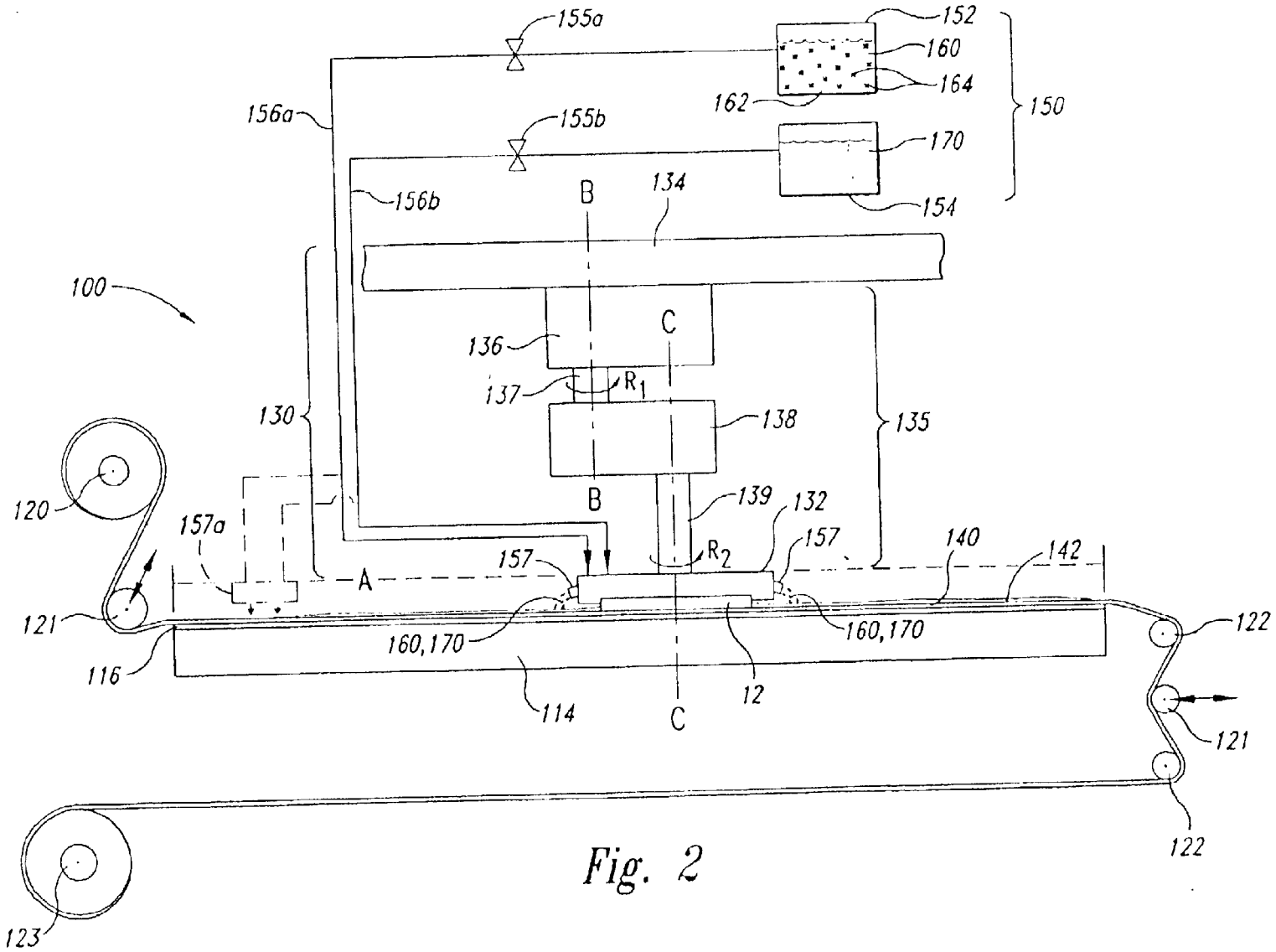
FIG. 2 is a schematic cross-sectional view of a web-format planarizing machine with a planarizing solution storage/delivery unit in accordance with one embodiment of the invention.

FIG. 2 is a schematic isometric view of a web-format planarizing machine 100 having a planarizing solution storage/delivery unit 150 in accordance with an embodiment of the invention. The planarizing machine 100 has a support table 114 with a top panel 116 to support a planarizing pad 140. The top panel 116 is generally a rigid plate to provide a flat, solid surface to which an operative portion (A) of the planarizing pad 140 may be secured.

The planarizing machine 100 also has a plurality of rollers to guide, position and hold the planarizing pad 140 on the top panel 116. The rollers include a supply roller 120, idler rollers 121, guide rollers 122, and a take-up roller 123. The supply roller 120 carries an unused or pre-operative portion of the planarizing pad 140, and the take-up roller 123 carries a used or post-operative portion of the planarizing pad 140. Additionally, the left idler roller 121 and the upper guide roller 122 stretch the planarizing pad 140 over the top panel 116 to secure the planarizing pad 140 to the table 114 during a planarizing cycle. A motor (not shown) generally drives the take-up roller 123 to sequentially advance the planarizing pad 140 across the top panel 116, and the motor can also drive the supply roller 120. Accordingly, a clean pre-operative portion of the planarizing pad 140 may be quickly substituted for used portions to provide a consistent surface for planarizing and/or cleaning the substrate 12.

The web-format planarizing machine 100 also has a carrier assembly 130 that controls and protects the substrate 12 during planarization. The carrier assembly 130 generally has a substrate holder 132 to pick up, hold and release the substrate 12 at appropriate stages of a planarizing cycle. The carrier assembly 130 also generally has a support gantry 134 carrying a drive assembly 135 that can translate along the support gantry 134. The drive assembly 135 generally has an actuator 136, a drive shaft 137 coupled to the actuator 136, and an arm 138 projecting from the drive shaft 137. The arm 138 carries the substrate holder 132 via a terminal shaft 139 such that the drive assembly 135 orbits the substrate holder 132 about an axis B—B (arrow $R_1$). The terminal shaft 139 may also rotate the substrate holder 132 about its central axis C—C (arrow $R_2$).

Figure 3:
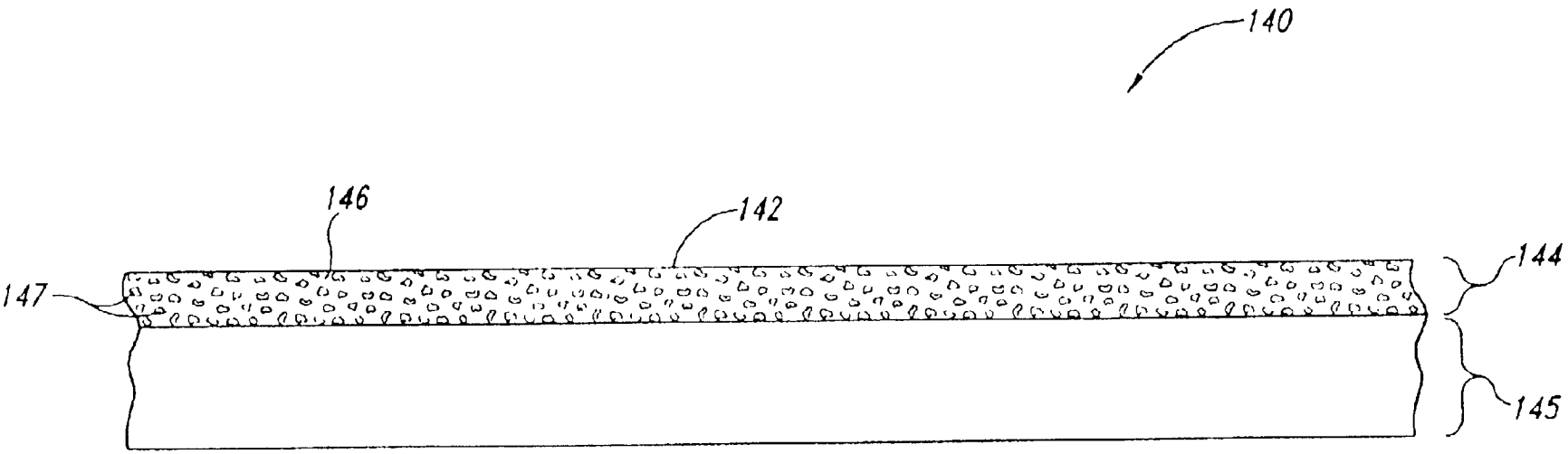
FIG. 3 is a schematic partial cross-sectional view of a fixed-abrasive planarizing pad for use on a planarizing machine in accordance with the invention.

The planarizing pad 140 is a fixed-abrasive pad having an abrasive planarizing medium. FIG. 3 is a schematic cross-sectional view of one embodiment of the fixed abrasive planarizing pad 140. In this embodiment, the planarizing pad 140 includes an abrasive planarizing medium 144 and a backing sheet 145. The planarizing medium can have a binder 146 and a plurality of first abrasive particles 147 distributed in the binder 146. The binder 146 is generally a resin or other suitable material, and the first abrasive particles 147 are generally alumina, ceria, titania, silica or other suitable abrasive particles. At least some of the abrasive particles 147 are partially exposed at a planarizing surface 142 of the planarizing medium 144. The backing sheet 145 is generally a durable, flexible material that provides structural integrity for the planarizing medium 144. Suitable fixed-abrasive planarizing pads 140 are disclosed in U.S. Pat. Nos. 5,645,471; 5,879,222; 5,624,303; and U.S. patent application Nos. Ser. 09/164,916 and 09/001,333; all of which are herein incorporated by reference.

Referring again to FIG. 2, this embodiment of the planarizing solution storage/delivery unit 150 includes a first supply 152 of a first planarizing solution 160 and a second supply 154 of a second planarizing solution 170. The first planarizing solution 160 is an abrasive slurry having a liquid 162 and a plurality of second abrasive particles 164 suspended in the liquid 162. The liquid 162 is generally an aqueous solution including surfactants, oxidants, etchants, lubricants and/or other ingredients that either control the distribution of the second abrasive particles 164 in the liquid 162 or the chemical interaction with the substrate 12. The second abrasive particles 164 can comprise ceria, alumina, titania, silica and other types of abrasive particles known in the chemical-mechanical planarization arts. The second planarizing solution 170 is a non-abrasive solution without abrasive particles. The liquid 162 of the first planarizing solution 160 and the liquid of the second planarizing solution 170 may have the same compositions, or they may have different compositions depending upon the requirements of a particular application.

The planarizing solution storage/delivery unit 150 further includes first and second valves 155*a* and 155*b*. The first and second valves 155*a* and 155*b* are preferably solenoid valves that can be operated electronically using a computer or another type of control unit. The first valve 155*a* is coupled to a first conduit 156*a*, and the second valve 155*b* is coupled to a second conduit 156*b*. The first conduit 156*a* is coupled to the first supply 152 of the first planarizing solution 160, and the second conduit 156*b* is coupled to the second supply 154 of the second planarizing solution 170. The first and second conduits 156*a* and 156*b* are also coupled to a dispenser 157 over the planarizing pad 140. The dispenser 157 preferably comprises a plurality of nozzles coupled to the substrate holder 132. The dispenser, however, can also be a stand alone unit positioned apart from the substrate holder 132 (shown by reference number 157*a* in broken lines). The first and second valves 155*a* and 155*b* accordingly control the flows of the first and second planarizing solutions 160 and 170 to the dispenser 157 to dispense either only the first planarizing solution 160, only the second planarizing solution 170, or a combination of the first and second planarizing solutions 160 and 170 at various stages of a planarizing cycle. Several embodiments of methods for planarizing the microelectronic substrate 12 using the planarizing machine 100 are described below.

In one embodiment of operating the planarizing machine 100, a first stage of a planarizing cycle involves effectuating a flow of only the first planarizing solution 160 to the dispenser 157 by opening the first valve 155*a* and closing the second valve 155*b*. The first stage of the planarizing cycle can include a pre-wetting phase before the substrate 12 rubs against the planarizing pad 140, and/or an initial planarizing phase in which the substrate 12 rubs against the planarizing pad 140. The flow of the first planarizing solution 160 can continue throughout the first stage of the planarizing cycle, or the flow of the first planarizing solution 160 can be terminated shortly after the substrate 12 begins rubbing against the pad 140. The first stage of the planarizing cycle accordingly involves covering at least a portion of the planarizing surface 142 with the abrasive first planarizing solution 160. As such, material is initially removed from the microelectronic substrate 12 by rubbing the substrate 12 against the first abrasive particles 147 attached to the planarizing surface 142 and the second abrasive particles 164 in the first planarizing solution 160 on the planarizing pad 140.

After the first stage of the planarizing cycle, a second stage of the planarizing cycle involves effectuating a flow of only the second planarizing solution 170 to the dispenser 157 by closing the first valve 155*a* and opening the second valve 155*b*. The flow of the non-abrasive second planarizing solution 170 during the second stage reduces or adjusts the concentration of the second abrasive particles 164 from the first planarizing solution 160 on the planarizing surface 142 of the planarizing pad 140. The flow of the second planarizing solution 170 through the dispenser 157 can be continued throughout the second stage of the planarizing cycle until the substrate 12 reaches a desired endpoint.

The embodiment of the method for operating the planarizing machine 100 described above is expected to provide a more consistent polishing rate throughout a planarizing cycle using fixed-abrasive planarizing pads. Conventional fixed-abrasive planarizing applications that use only a non-abrasive planarizing solution throughout the planarizing cycle typically have a low polishing rate at the beginning of the planarizing cycle. One explanation for this phenomena is that some of the abrasive particles fixed to the planarizing pad break away from the resin binder during an initial stage of the planarizing cycle and, in essence, produce an abrasive-like slurry from the non-abrasive planarizing solution. Unlike conventional fixed-abrasive planarizing processes, the embodiment of the method for operating the planarizing machine 100 described above covers the fixed-abrasive planarizing pad 140 with the abrasive first planarizing solution 160 at a pre-wetting phase or an initial phase of the first stage of a planarizing cycle to provide an immediate slurry for planarizing the substrate. The non-abrasive second planarizing solution 170 is then substituted for the first planarizing solution 160 at a second stage of the planarizing cycle when it is expected that the substrate assembly 12 and the abrasive planarizing solution 160 have detached a portion of the abrasive particles that were previously affixed to the planarizing pad. Therefore, by covering the planarizing pad 140 with an abrasive planarizing solution 160 at a first stage of the planarizing cycle and then coating the planarizing surface 142 with a non-abrasive planarizing solution 170 at a second stage of the planarizing cycle, this embodiment of the method for operating the planarizing machine 100 is expected to increase the polishing rate during the initial stage of the planarizing cycle to be closer to the polishing rate at the subsequent stage of the planarizing cycle.

In another embodiment of a method for operating the planarizing machine 100, the first stage of the planarizing cycle includes effectuating the flow of the first planarizing solution 160, and the second stage includes effectuating flow of only the second planarizing solution 170 during an opening phase of the second stage. After the opening phase of the second stage, this embodiment includes terminating the flow of the second planarizing solution 170 by closing the valve 155*b*, and re-effectuating a subsequent flow of the first planarizing solution 160 by opening the first valve 155*a* at a subsequent phase of the second stage. As such, only the first planarizing solution 160 flows through the dispenser 157 during the subsequent phase of the second stage of the planarizing cycle. The flows of the first and second planarizing solutions can thus alternate during the second stage according to one embodiment of this method.

This embodiment for operating the planarizing machine 100 is particularly useful for planarizing a substrate after the surface has become substantially planar because the additional abrasive particles 164 in the first planarizing solution 160 increase the polishing rate of the blanket surface on the substrate 12. This embodiment can further include sensing a surface condition of the substrate (e.g., a blanket layer), and then commencing the subsequent phase of the second stage. A blanket layer, for example, can be sensed by monitoring the optical reflectance from the substrate or the drag force between the substrate and the pad. A suitable reflectance and drag force monitoring system is set forth in U.S. Pat. No. 09/386,648, which is herein incorporated by reference.

The planarizing machine 100 can also be operated by combining the flows of the first and second planarizing solutions 160 and 170 during the second stage of the planarizing cycle. In this embodiment, therefore, the abrasive first solution 160 is dispensed onto the planarizing surface 142 either as a pre-wet or during an initial contact phase of the first stage of the planarizing cycle. The second planarizing solution 170 is then dispensed onto the planarizing surface 142 at a second stage of the planarizing cycle either in combination with a flow of the first planarizing solution 160 or completely separate from the flow of the first planarizing solution 160. In either case, the flows of the first and second planarizing solutions 160 and 170 are controlled to adjust the concentration of the abrasive particles 164 from the first planarizing solution 160 during the second stage of the planarizing cycle.

Figure 4:
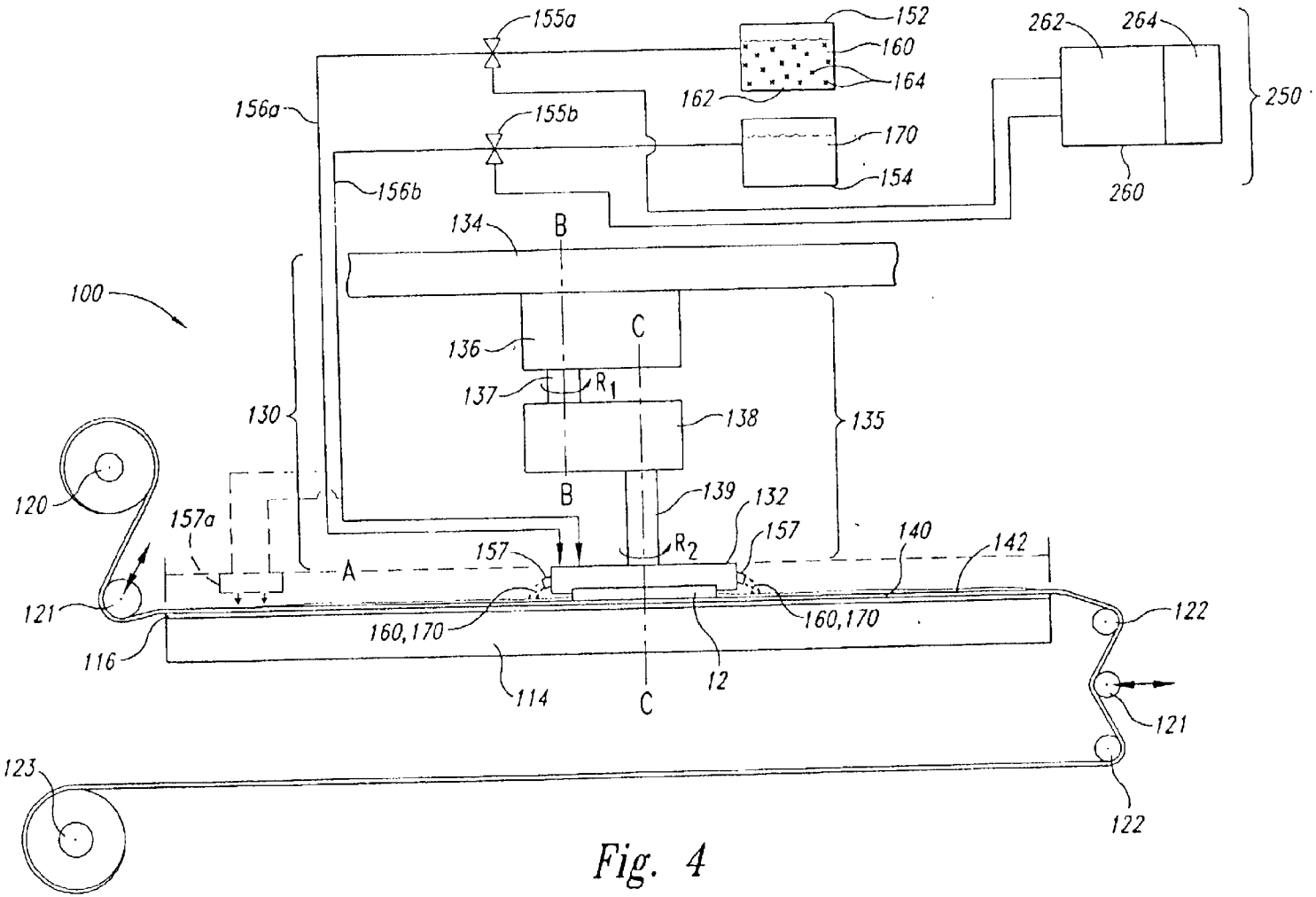
FIG. 4 is a schematic cross-sectional view of a web-format planarizing machine with a planarizing solution storage/delivery unit in accordance with another embodiment of the invention.

FIG. 4 is a schematic isometric view of the planarizing machine 100 with a planarizing solution storage/delivery unit 250 in accordance with another embodiment of the invention. In this embodiment, the storage/delivery unit 250 includes the first supply 152 of the abrasive first planarizing solution 160 and the second supply 154 of the non-abrasive second planarizing solution 170 described above with reference to FIG. 2. The storage/delivery unit 250 also includes a controller 260 having a computer 262 and a computable-readable medium 264. The controller 260 is coupled to the first and second valves 155*a* and 155*b* to open and close the valves according to the commands from the computable-readable medium 264. The computable-readable medium 264 has a computable-readable program with a program code for effectuating one or more of the different flows of the first and second planarizing solutions 160 and 170 during the first and second stages of the planarizing cycle described above with reference to FIG. 2. A person skilled in the art can prepare the computer-readable program code without undue experimentation based upon the present disclosure.

From the foregoing, it will be appreciated that specific embodiments of the invention have been described herein for purposes of illustration, but that various modifications may be made without deviating from the spirit and scope of the invention. For example, the first planarizing particles fixedly-attached to the pad and the second abrasive particles suspended in the first planarizing solution can have the same or different size, shape and/or composition. In another example, the second solution can be added to the first solution or the first solution can be added to the second solution according to a detected change in the surface condition of the substrate. The addition of the first or second planarizing solutions can occur upon detecting a blanket surface on the substrate or a change in materials according to the drag force between the substrate and the planarizing medium. The drag force can be measured by load cells or torque on the drive motor. Suitable devices and methods for monitoring the drag force are set forth in U.S. Pat. Nos. 5,036,015 and 5,069,022, and U.S. application Ser. No. 09/386,648, all of which are herein incorporated by reference. Accordingly, the invention is not limited except as by the appended claims.

What is claimed is:

1. A planarizing machine for mechanical and/or chemical-mechanical planarization of microelectronic substrates, comprising:

a table having a support surface;

a fixed-abrasive planarizing pad on the support surface of the table, the fixed-abrasive pad having a planarizing medium with an abrasive planarizing surface, the planarizing medium comprising a binder and a first plurality of abrasive particles fixedly attached to the binder, wherein at least a share of the first abrasive particles are exposed at the planarizing surface;

a carrier assembly having a head for holding a substrate assembly and a drive mechanism for moving the head relative to the planarizing pad;

a first supply of an abrasive first planarizing solution coupled to a dispenser positionable over the planarizing pad, wherein the first planarizing solution has a liquid and a second plurality of abrasive particles suspended in the liquid;

a second supply of a second planarizing solution coupled to the dispenser, wherein the second planarizing solution is a non-abrasive solution without abrasive particles; and a computer operatively coupled to the first supply of the first planarizing solution and the second supply of the second planarizing solution, the computer having a computer-readable medium containing a computer-readable program code that causes the computer to (a) effect a first flow of the first planarizing solution to the dispenser at a first stage of a planarizing cycle of a microelectronic substrate, and (b) effect a second flow of the second planarizing solution to the dispenser at a second stage of the planarizing cycle after the first stage.

2. The planarizing machine of claim 1 wherein the computer-readable program code comprises causing the computer to open a first valve coupled to the first supply during the first stage to dispense a fixed volume of the first planarizing solution onto the planarizing pad before rubbing the microelectronic substrate against the planarizing pad.

3. The planarizing machine of claim 1 wherein the computer-readable program code comprises causing the computer to open a first valve coupled to the first supply during the first stage to effect the flow of the first planarizing solution onto the planarizing pad and then to close the first valve to terminate the flow of the first solution before rubbing the microelectronic substrate against the planarizing pad.

4. The planarizing machine of claim 1 wherein the computer-readable program code comprises causing the computer to open a first valve coupled to the first supply during the first stage to effect the flow of the first planarizing solution onto the planarizing pad while rubbing the microelectronic substrate against the planarizing pad before the second stage.

5. The planarizing machine of claim 1 wherein:

the computer-readable program code comprises causing the computer to open a first valve coupled to the first supply during the first stage to effect the flow of the first planarizing solution and then to close the first valve to terminate the flow of the first planarizing solution; and the computer-readable program code comprises causing the computer to open a second valve coupled to the second supply during the second stage to effect the flow of the second planarizing solution after terminating the flow of the first planarizing solution.

6. The planarizing machine of claim 1 wherein:

the computer-readable program code comprises causing the computer to open a first valve coupled to the first supply during the first stage to effect the flow of the first planarizing solution; and the computer-readable program code comprises causing the computer to open a second valve coupled to the second supply during the second stage to subsequently effect the flow of the second planarizing solution while continuing the flow of the first planarizing solution to deposit a combination of the first and second planarizing solutions on the planarizing pad.

7. The planarizing machine of claim 1 wherein:

the computer-readable program code comprises causing the computer to open a second valve coupled to the second supply during the second stage to effect the flow of the second planarizing solution after terminating the flow of the first planarizing solution during an opening phase of the second stage; and the computer-readable program code comprises causing the computer to re-open the first valve to re-effect the flow of the first planarizing solution upon detecting a surface condition of the substrate at a subsequent phase of the second stage of the planarizing cycle.

8. The planarizing machine of claim 1 wherein the first abrasive particles in the planarizing medium and the second abrasive particles in the first planarizing solution have the same composition.

9. The planarizing machine of claim 1 wherein the first abrasive particles in the planarizing medium have a first composition and the second abrasive particles in the first planarizing solution have a second composition different than the first composition.

10. The planarizing machine of claim 1 wherein the first abrasive particles in the planarizing medium have a first size and the second abrasive particles in the first planarizing solution have a second size different than the first size.

11. The planarizing machine of claim 1 wherein the first abrasive particles in the planarizing medium have a first shape and the second abrasive particles in the first planarizing solution have a second shape different than the first shape.

12. A planarizing machine for mechanical and/or chemical-mechanical planarization of microelectronic substrates, comprising:

a table having a support surface;

a fixed-abrasive planarizing pad on the support surface of the table, the fixed-abrasive pad having a planarizing medium with an abrasive planarizing surface, the planarizing medium comprising a binder and a first plurality of abrasive particles fixedly attached to the binder, wherein at least a share of the first abrasive particles are exposed at the planarizing surface;

a carrier assembly having a head for holding a substrate assembly and a drive mechanism for moving the head relative to the planarizing pad;

a first supply of an abrasive first planarizing solution coupled to a dispenser positionable over the planarizing pad, wherein the first planarizing solution has a liquid and a second plurality of abrasive particles suspended in the liquid;

a second supply of a second planarizing solution coupled to the dispenser, wherein the second planarizing solution is a non-abrasive solution without abrasive particles; and a computer operatively coupled to the first supply of the first planarizing solution and the second supply of the second planarizing solution, the computer having a computer-readable medium containing a computer-readable program code that causes the computer to effect (a) a flow of the first planarizing solution to the dispenser at a first stage of a planarizing cycle of a microelectronic substrate, and (b) a reduction of a concentration of the first abrasive particles on the planarizing pad during a second stage of the planarizing cycle after the first stage.

13. The planarizing machine of claim 12 wherein the computer-readable program code comprises causing the computer to effectuate a flow of a non-abrasive second planarizing solution without abrasive particles onto the planarizing pad during the second stage of the planarizing cycle.

14. The planarizing machine of claim 13 wherein the computer-readable program code comprises causing the computer to terminate the flow of the first planarizing solution at the end of the first stage before effectuating the flow of the second planarizing solution at the commencement of the second stage.

15. The planarizing machine of claim 13 wherein the computer-readable program code comprises causing the computer to continuously maintain the flow of the first planarizing solution during the first and second stages of the planarizing cycle.

16. A planarizing machine for mechanical and/or chemical-mechanical planarization of microelectronic substrates, comprising:

a table having a support surface;

a fixed-abrasive planarizing pad on the support surface of the table, the fixed-abrasive pad having a planarizing medium with an abrasive planarizing surface, the planarizing medium comprising a binder and a first plurality of abrasive particles fixedly attached to the binder, wherein at least a share of the first abrasive particles are exposed at the planarizing surface;

a carrier assembly having a head for holding a substrate assembly and a drive mechanism for moving the head relative to the planarizing pad;

a first supply of an abrasive first planarizing solution coupled to a dispenser positionable over the planarizing pad, wherein the first planarizing solution has a liquid and a second plurality of abrasive particles suspended in the liquid;

a second supply of a second planarizing solution coupled to the dispenser, wherein the second planarizing solution is a non-abrasive solution without abrasive particles; and a computer operatively coupled to the first supply of the first planarizing solution and the second supply of the second planarizing solution, the computer having a computer-readable medium containing a computer-readable program code that causes the computer to effect a method comprising covering at least a portion of the planarizing surface with the abrasive first planarizing solution during a first stage of a planarizing cycle of a microelectronic substrate:

pressing the microelectronic substrate against the first abrasive particles at the planarizing surface and the second abrasive particles suspended in the first planarizing solution, and moving the microelectronic substrate and/or the planarizing pad to rub the microelectronic substrate against the planarizing surface; and adjusting a concentration of the second abrasive particles on the planarizing surface at a second stage of the planarizing cycle after the first stage.

17. The planarizing machine of claim 16 wherein the computer-readable program code further comprises causing the computer to effectuate a flow of the non-abrasive second planarizing solution without abrasive particles onto the planarizing pad during the second stage of the planarizing cycle.

18. The planarizing machine of claim 17 wherein the computer-readable program code further comprises causing the computer to terminate the flow of the first planarizing solution at the end of the first stage of the planarizing cycle before effectuating the flow of the second planarizing solution at the commencement of the second stage of the planarizing cycle.

19. The planarizing machine of claim 17 wherein the computer-readable program code further comprises causing the computer to continuously maintain the flow of the first planarizing solution during the first stage and the second stage of the planarizing cycle.

* * * * *